US008172590B2

(12) United States Patent
Zhou

(10) Patent No.: US 8,172,590 B2
(45) Date of Patent: May 8, 2012

(54) CONNECTING STRUCTURE OF A LAMP HEAD BASE AND A LAMP TUBE BASE

(75) Inventor: Nan-Qing Zhou, Fujian (CN)

(73) Assignee: Mainhouse (Xiamen) Electronics Co., Ltd., Xiamen, Fujian (CN)

( * ) Notice: Subject to any disclaimer, the term of this patent is extended or adjusted under 35 U.S.C. 154(b) by 0 days.

(21) Appl. No.: 12/743,233

(22) PCT Filed: May 22, 2009

(86) PCT No.: PCT/CN2009/071923

§ 371 (c)(1),
(2), (4) Date: May 15, 2010

(87) PCT Pub. No.: WO2010/025629

PCT Pub. Date: Mar. 11, 2010

(65) Prior Publication Data

US 2011/0136370 A1 Jun. 9, 2011

(30) Foreign Application Priority Data

Sep. 2, 2008 (CN) ..... 2008 2 0145459 U

(51) Int. Cl.
*H01R 33/02* (2006.01)

(52) U.S. Cl. ..... 439/236; 439/646; 439/953

(58) Field of Classification Search ..... 313/318.03, 313/318.04; 439/236, 642, 646, 613–619
See application file for complete search history.

(56) References Cited

U.S. PATENT DOCUMENTS

| | | | | | |
|---|---|---|---|---|---|
| 4,564,257 | A | * | 1/1986 | Smerz | 439/642 |
| 4,828,510 | A | * | 5/1989 | Muzslay | 439/352 |
| 5,109,453 | A | * | 4/1992 | Edwards et al. | 385/90 |
| 5,286,216 | A | * | 2/1994 | Volz | 439/236 |
| 5,316,493 | A | * | 5/1994 | Sowers | 439/346 |
| 5,428,515 | A | * | 6/1995 | Jung | 362/640 |
| 5,435,748 | A | * | 7/1995 | Abe | 439/489 |
| 5,653,527 | A | * | 8/1997 | Muessli | 362/650 |
| 5,700,154 | A | * | 12/1997 | Geary | 439/236 |
| 6,033,250 | A | * | 3/2000 | Pauza | 439/357 |

(Continued)

FOREIGN PATENT DOCUMENTS

JP 9185979 * 7/1997

*Primary Examiner* — Neil Abrams

(57) ABSTRACT

The present invention relates to a connecting structure of a lamp head base (2) and a lamp tube base (3). The lamp head base (2) includes an upper cover (21) and a lower cover (22) to engage with each other. The lower cover (22) has two troughs (221) which face downward and a through hole (222) disposed between the two troughs (221). A locking base (5) is connected to the lower cover (22). The locking base (5) includes a press surface (51) which is exposed outside an outer surface of the lower cover (22) and a hook (52) at an inner end thereof. The hook (52) is located above the through hole (222). The lamp tube base (3) includes two tubular sleeves (31) to fix two feet (41) which extend upward from a lamp tube (4), a connecting portion (32) to secure the two tubular sleeves (31), and a locking slot (33) disposed above the connecting portion (32). When assembling, the two tubular sleeves (31) and the connecting portion (32) of the lamp tube base (3) are respectively inserted in the two troughs (221) and the through hole (222) of the lower cover (22) of the lamp head base (2), and the hook (52) of the locking base (5) engages with the locking slot (33) of the lamp tube base (3).

4 Claims, 3 Drawing Sheets

U.S. PATENT DOCUMENTS 6,036,522 A * 3/2000 Holzer ..... 439/306
7,097,508 B1 * 8/2006 Yang ..... 439/617
7,125,159 B2 * 10/2006 Hirsch et al. ..... 362/651
7,905,626 B2 * 3/2011 Shantha et al. ..... 362/228
7,955,111 B2 * 6/2011 Costabel et al. ..... 439/287
8,002,585 B2 * 8/2011 Zhou ..... 439/642
2010/0167576 A1 * 7/2010 Zhou ..... 439/375
2011/0136370 A1 * 6/2011 Zhou ..... 439/366

* cited by examiner

CONNECTING STRUCTURE OF A LAMP HEAD BASE AND A LAMP TUBE BASE

BACKGROUND OF THE INVENTION

1. Field of the Invention

The present invention relates to a lighting device, and more particularly to a connecting structure of a lamp head base and a lamp tube base.

2. Description of the Prior Art

Most compact fluorescent lamps have a replaceable structure which is disposed between a lamp head and a lamp head base as well as between the lamp head base and a lamp tube base, such that the user can replace a lamp head in a different size or shape as well as a lamp tube in a different shape. When one part of the lamp is damaged, only the damaged part is replaced so as to save cost. For the lamp manufacturers, they can standardize each part of the lamp. When developing a new product, the lamp manufacturer only needs a new mold for the changed part. This way can reduce the manufacture cost very much.

As to the replaceable connection way between the lamp head base and the lamp tube base, Chinese patent application number 20072000644.8 disclosed "a replaceable compact fluorescent lamp" and Chinese patent application number 20072007251.8 disclosed "a replaceable lamp head". As disclosed in the two patent applications, the lamp tube base must be large in size for connecting with the lamp head base, which uses more material. When the lamp tube is damaged, the lamp tube base must be replaced along with the lamp tube. This wastes material and is not environmental friendly.

SUMMARY OF THE INVENTION

The primary object of the present invention is to provide a connecting structure of a lamp head base and a lamp tube base. The lamp tube base is compact so as to decrease the waste of material when replacement.

According to the present invention, there is provided a connecting structure of a lamp head base and a lamp tube base. The lamp head base comprises an upper cover and a lower cover to engage with each other. The lower cover has two troughs which face downward and a through hole disposed between the two troughs. A locking base is connected to the lower cover. The locking base comprises a press surface which is exposed outside an outer surface of the lower cover and a hook at an inner end thereof. The hook is located above the through hole. The lamp tube base includes two tubular sleeves to fix two feet which extend upward from a lamp tube, a connecting portion to secure the two tubular sleeves, and a locking slot disposed above the connecting portion. When assembling, the two tubular sleeves and the connecting portion of the lamp tube base are respectively inserted in the two troughs and the through hole of the lower cover of the lamp head base, and the hook of the locking base engages with the locking slot of the lamp tube base.

Preferably, the lower cover has a guide trough disposed at same sides of the two troughs, and the locking base comprises a guide post at a lower end thereof to slide within the guide trough.

Preferably, a spring is provided between the locking base and the lower cover.

Preferably, the connecting portion of the lamp tube base has a pointed top.

The lamp tube base of the present invention uses the two tubular sleeves to fix the feet of the lamp tube and the connecting portion having the locking slot for engagement. The present invention is simple in structure and small in size. Compared to similar products, the required material of the present invention is reduced. When the lamp tube is damaged, the material to throw away is less, which can decrease the waste of material. Besides, it is convenient to assemble the present invention by pressing the press surface of the locking base to control the engagement of the hook and the locking slot. This connection is reliable.

DETAILED DESCRIPTION OF THE PREFERRED EMBODIMENTS

Embodiments of the present invention will now be described, by way of example only, with reference to the accompanying drawings.

Figure 1:
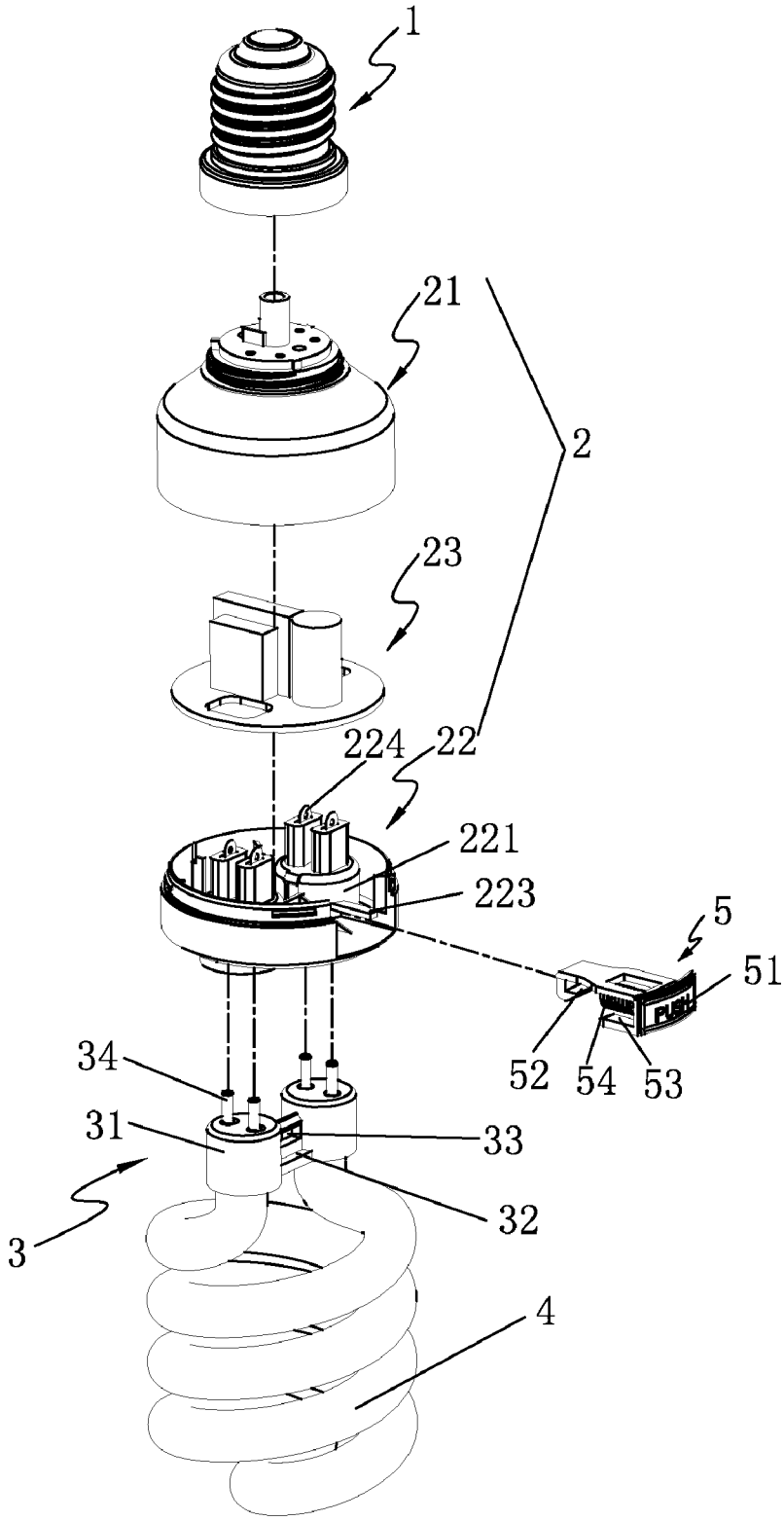
FIG. 1 is an exploded view of the present invention.
Figure 2:
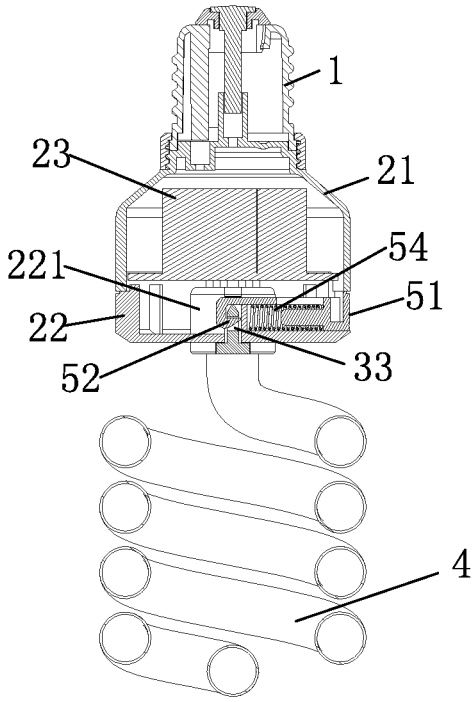
FIG. 2 is a cross-sectional view of the present invention.
Figure 3:
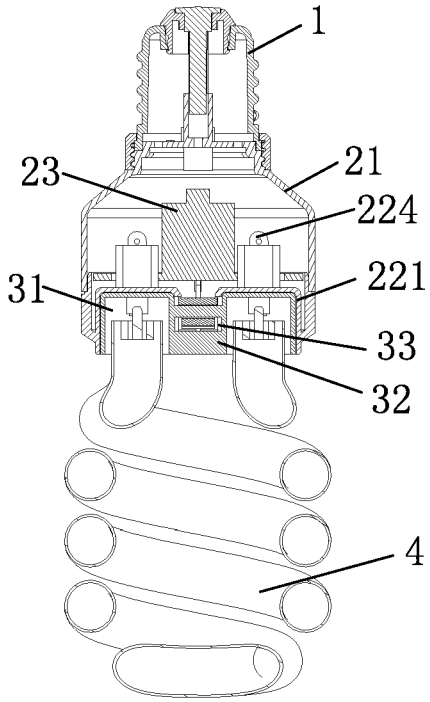
FIG. 3 is another cross-sectional view of the present invention.

As shown in FIGS. 1 to 3, a connecting structure of a lamp head base 2 and a lamp tube base 3. A lamp head 1 is provided on the lamp head base 2. The lamp head 1 can be detachably or fixedly connected to the lamp head base 2. This is not the feature of the present invention, and won't be described hereinafter. The lamp tube base 3 is adapted to connect with a lamp tube 4.

Figure 4:
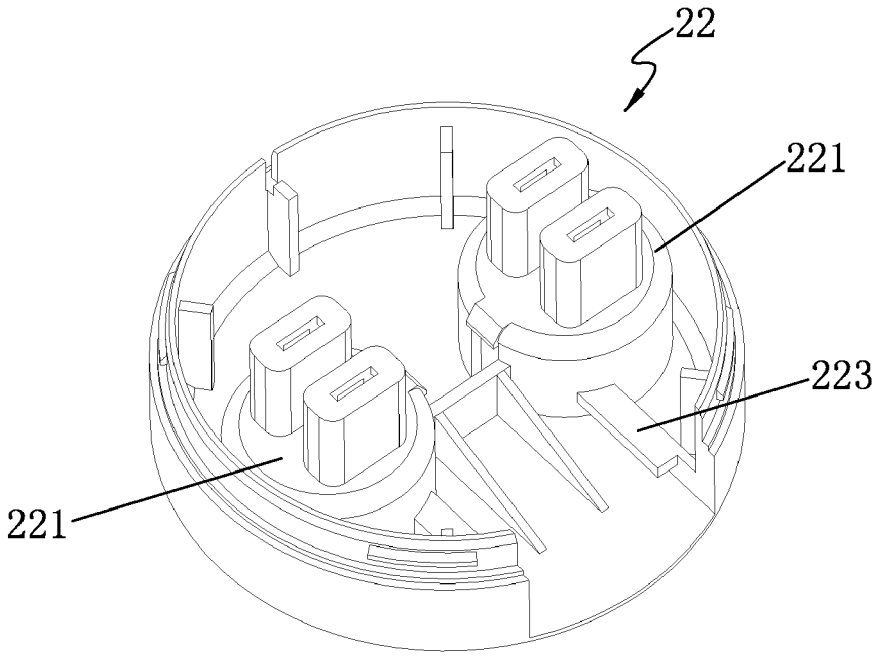
FIG. 4 is a schematic view of the lower cover of the lamp head base of the present invention.
Figure 5:
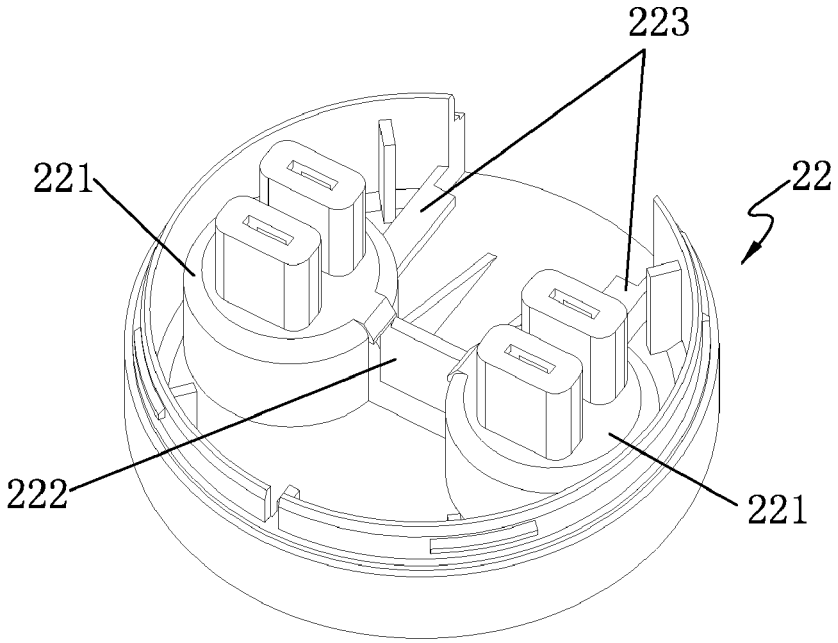
FIG. 5 is another schematic view of the lower cover of the lamp head base of the present invention.

The lamp head base 2 comprises an upper cover 21 and a lower cover 22 to engage with each other for fixing electric members 23, such as a rectifier, a circuit board, and the like. As shown in FIGS. 4 and 5, the lower cover 22 has two troughs 221 which face downward, a through hole 222 disposed between the two troughs 221, and a guide trough 223 disposed at same sides of the two troughs 221. A locking base 5 is connected to the lower cover 22. The locking base 5 comprises a press surface 51 which is exposed outside an outer surface of the lower cover 22, a hook 52 at an inner end thereof, a guide post 53 at a lower end thereof, and a spring 54 located between the locking base 5 and the lower cover 22. The hook 52 is located above the through hole 222. The guide post 53 is moved to slide within the guide trough 223. The spring 54 is adapted to return the locking base 5. Furthermore, conductive plates 224 are provided on top of the two troughs 221.

The lamp tube base 3 includes two tubular sleeves 31 to fix two feet 41 which extend upward from the lamp tube 4, a connecting portion 32 to secure the two tubular sleeves 31, and a locking slot 33 disposed above the connecting portion 32. The connecting portion 32 has a pointed top. Furthermore, conductive posts 34 are provided on the two tubular sleeves 31.

When connecting the lamp tube base 3 to the lamp head base 2, the two tubular sleeves 31 of the lamp tube base 3 are inserted in the two troughs 221 of the lower cover 22 of the lamp head base 2, and the connecting portion 32 is inserted in the through hole 222 with the pointed top of the connecting portion 32 to push the locking base 5. The hook 52 of the locking base 5 engages with the locking slot 33 of the lamp tube base 3 by the force from the spring 54 of the locking base 5, such that the lamp tube base 3 is coupled to the lamp head base 2. The conductive posts 34 of the lamp tube base 3 are in contact with the conductive plates 224 of the lower cover 22 for electric conduction.

When replacing the lamp tube 4, the press surface 51 of the locking base 5 is pressed to retract the locking base 5, such that the hook 52 disengages from the locking slot 33 of the lamp tube base 3 and the lamp tube 4 can be pulled out from the lamp tube base 3.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A connecting structure of a lamp head base (2) and a lamp tube base (3), the lamp head base (2) comprising an upper cover (21) and a lower cover (22) to engage with each other, the lower cover (22) having two troughs (221) which face downward and a through hole (222) disposed between the two troughs (221); a locking base (5) being connected to the lower cover (22), the locking base (5) comprising a press surface (51) which is exposed outside an outer surface of the lower cover (22) and a hook (52) at an inner end thereof, the hook (52) being located above the through hole (222); the lamp tube base (3) including two tubular sleeves (31) to fix two feet (41) which extend upward from a lamp tube (4), a connecting portion (32) to secure the two tubular sleeves (31), and a locking slot (33) disposed above the connecting portion (32); when assembling, the two tubular sleeves (31) and the connecting portion (32) of the lamp tube base (3) being respectively inserted in the two troughs (221) and the through hole (222) of the lower cover (22) of the lamp head base (2) and the hook (52) of the locking base (5) engaging with the locking slot (33) of the lamp tube base (3).

2. The connecting structure as claimed in claim 1, wherein the lower cover (22) has a guide trough (223) disposed at same sides of the two troughs (221), and the locking base (5) comprises a guide post (53) at a lower end thereof to slide within the guide trough (223).

3. The connecting structure as claimed in claim 1, wherein a spring (54) is provided between the locking base (5) and the lower cover (22).

4. The connecting structure as claimed in claim 1, wherein the connecting portion (32) of the lamp tube base (3) has a pointed top.

* * * * *